United States Patent [19]

Landaas

[11] Patent Number: 4,679,486

[45] Date of Patent: Jul. 14, 1987

[54] COMBINATION GUN WITH REPEATER MECHANISM

[76] Inventor: Viggo Landaas, 3740 Lunde, Norway

[21] Appl. No.: 708,050

[22] Filed: Mar. 4, 1985

[30] Foreign Application Priority Data

Mar. 7, 1984 [NO] Norway ..... 840857

[51] Int. Cl.[4] ..... F41F 11/04; F41F 13/04

[52] U.S. Cl. ..... 89/126; 89/1.41

[58] Field of Search ..... 89/126, 127, 172, 185, 89/1.41, 11

[56] References Cited

U.S. PATENT DOCUMENTS

| | | | |
|---|---|---|---|
| 993,175 | 5/1911 | Knötgen | 89/126 |
| 1,363,696 | 12/1920 | Thompson | 89/126 |
| 1,395,460 | 11/1921 | Thompson | 89/126 |
| 2,041,015 | 5/1936 | Onorati | 89/126 |
| 3,044,203 | 7/1962 | Wilhelm | 89/182 |
| 3,273,460 | 9/1966 | Mason | 89/185 |

FOREIGN PATENT DOCUMENTS

| | | | |
|---|---|---|---|
| 375138 | 11/1930 | Belgium . | |
| 920655 | 12/1954 | Fed. Rep. of Germany . | |
| 3252936 | 5/1984 | Fed. Rep. of Germany . | |
| 606829 | 11/1925 | France . | |
| 623998 | 11/1926 | France . | |
| 16785 | of 1886 | United Kingdom | 89/126 |

*Primary Examiner*—Charles T. Jordan
*Assistant Examiner*—Stephen M. Johnson
*Attorney, Agent, or Firm*—Cushman, Darby & Cushman

[57] ABSTRACT

A gun with two barrels of different calibers wherein both barrels have a repeater mechanism, manual or automatic, and wherein the weapon has a barrel-selector mechanism which selectively, as desired, brings one barrel into an operative state while at the same time putting the other barrel in an inoperative state. The breech block for the respective barrels are joined together via a cam on the breech block, such that the two breech blocks together constitute a cam mechanism which permits movement of the other breech block toward and away from the first breech block transversely of the barrels, and that the two breech blocks, during repeater-action of the weapon, move together and in parallel in the longitudinal direction of the barrels. The interconnected breech blocks thus together and synchronously lock the two breech blocks in their forward positions.

4 Claims, 7 Drawing Figures

COMBINATION GUN WITH REPEATER MECHANISM

Figure 1:
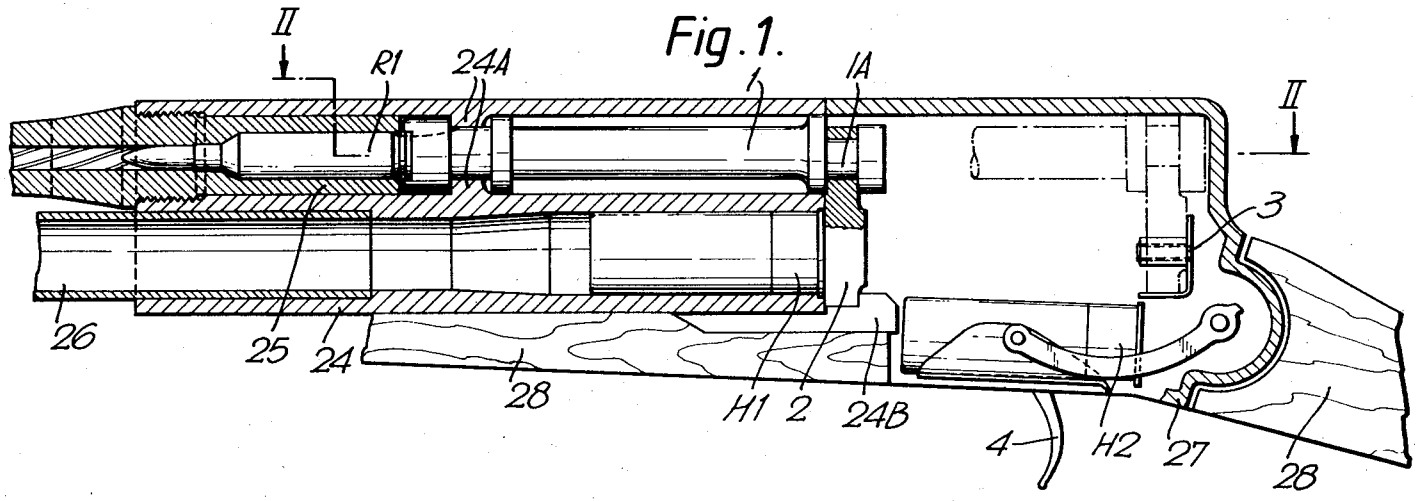

The present invention relates to a firearm, specifically a double-barreled gun with two different-caliber barrels.

Hunters who intend to shoot both large game as well as birds and small animals have had the choice either of carrying different guns for the two types of game, or of using a gun having no repeater mechanism or having a repeater mechanism for only one barrel of the gun. The types of hunting firearms generally used today, and their areas of use, are given below.

Rifles are intended for shooting large game and as a rule have a magazine for two or more shots.

Shotguns are intended mainly for use on small game and birds at relatively close range, and several varieties are available, with single or multiple shots.

A combination rifle/shotgun normally has only one shot per barrel, and it is intended to be used for both of the above purposes.

A so-called "drilling gun" has two shotgun barrels and one rifle barrel with one shot in each barrel, and it is also intended to cover both areas of use.

German Pat. No. 920,655 discloses a combination rifle/shotgun with a magazine for the shotgun barrel, and having one heavy-caliber and one light-caliber rifle barrel without a magazine. This design, however, has a number of drawbacks. The gun is front-heavy, long, clumsy and unwieldy. As far as can be determined, this gun has never actually been manufactured or used in practice.

The present invention provides a relatively compact combination gun with good precision for both barrels. The weapon has been constructed such that its weight is comparable to that of the multi-barrel shotguns and rifles on the market today. Rather than carrying two guns intended for different types of game but which often are both needed during a single hunting trip, a hunter using the gun of the invention will require only a single weapon, which is suitable for both types of game but which is not unduly heavy, clumsy or unwieldy.

Moreover, the gun of the invention permits repetitive firing from both barrels, which increases the capacity of the gun without adversely affecting its size and ease of use.

The gun of the invention also has a mechanism to permit selective firing from the respective barrels according to the position (operative/inoperative) in which the mechanism has been set. Therefore, a single trigger common to both barrels is sufficient. The mechanism will normally be set in the position which permits firing from the barrel which requires a quick response on the part of the hunter, for example when shooting at small game on the run or birds on the wing, so that the hunter can concentrate on his aim, not on pulling or selecting the correct trigger, which has been a major drawback of combination weapons in use today. However, if the hunter comes upon game which require that the rifle barrel be used, he will also in that case, owing to the slower movements of larger animals, their size, the longer range, etc., have sufficient time to set the rifle barrel in an operative state prior to the shot.

The weapon can be manufactured with an action, which from a manufacturing view compareable with bolt action or slide action mechanisms, and thus less expensive to make than bar action mechanisms which are used in other combination guns today.

The gun of the invention also has an ejector mechanism for spent shells, of a type known per se.

The above improvements are obtained in accordance with the invention in that both barrels have an automatic firing or repeater mechanism, and the weapon has a barrel-selector mechanism which brings one barrel into an operative state while simultaneously putting the other barrel in an inoperative state. The barrel-selector mechanism permits both barrels to be loaded at the same time, but only one barrel at a time, as determined by the selector mechanism, can be activated for firing, ejection of spent shells and loading of new shells, while these functions on the other barrel are in an inoperative state. In a third position, the barrel-selector mechanism locks all mechanism functions (safety). The weapon is also provided with dual breech blocks which are interconnected via a cam on one of the breech blocks, so that they together constitute a cam mechanism which permits movement of the second breech block toward and away from the first breech block transversely of the barrels. The breech blocks are interconnected so that, in accordance with the repeater action, they move together and in parallel in the longitudinal direction of the barrels. The joined breech blocks together and synchronously lock the two breech blocks in their forward position when the first barrel's breech block is pivoted to engage with lugs provided on the receiver (cylinder lock), while at the same time the other barrel's breech block, by means of the cam mechanism, engages with lugs provided on the receiver (slide lock). The gun has a single trigger.

The above-mentioned third position of the barrel-selector mechanism prevents both cocks from moving and thus constitutes a primary safety mechanism. The gun also has a trigger safety catch of known type, for use when the hunter is proceeding with the weapon cocked and ready for firing, which is quickly released when he decides to shoot.

Figure 2:
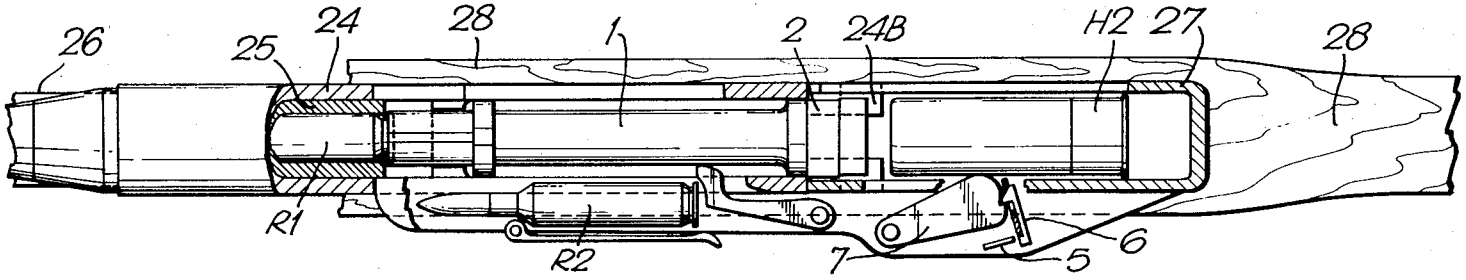
Figure 3:
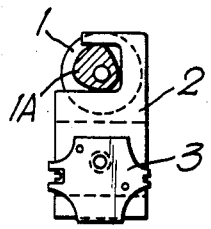
Figure 4:
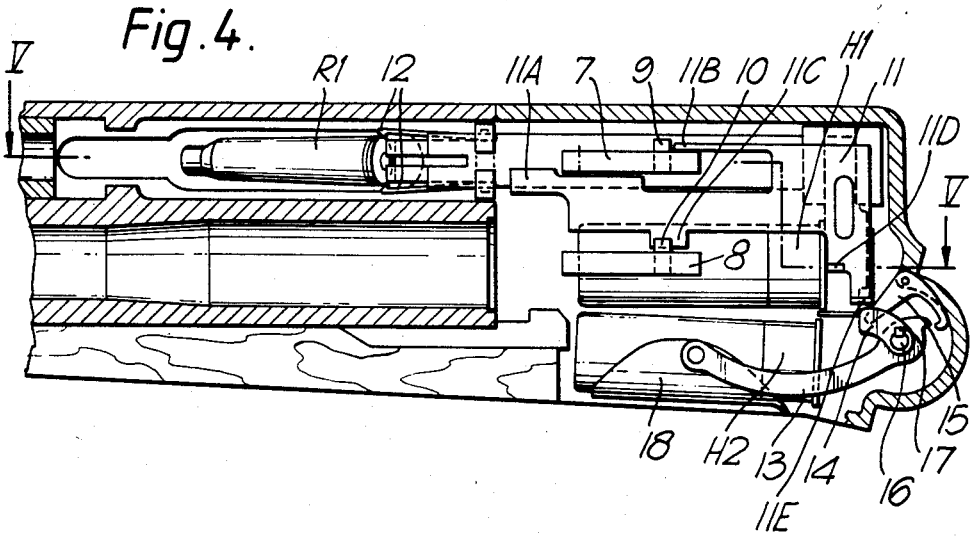
Figure 5:
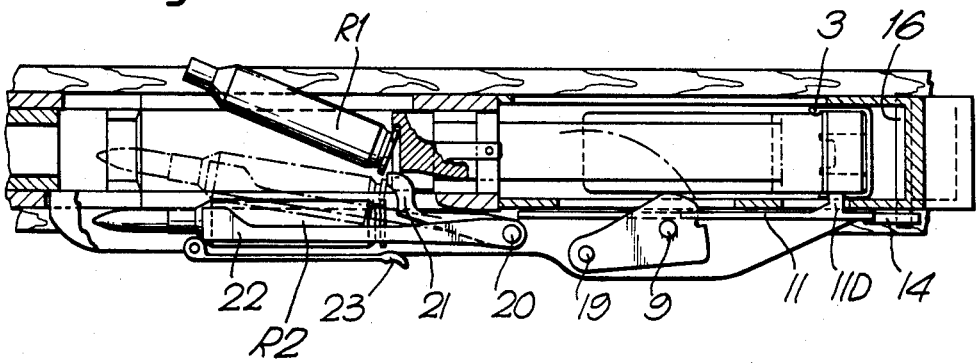
Figure 6:
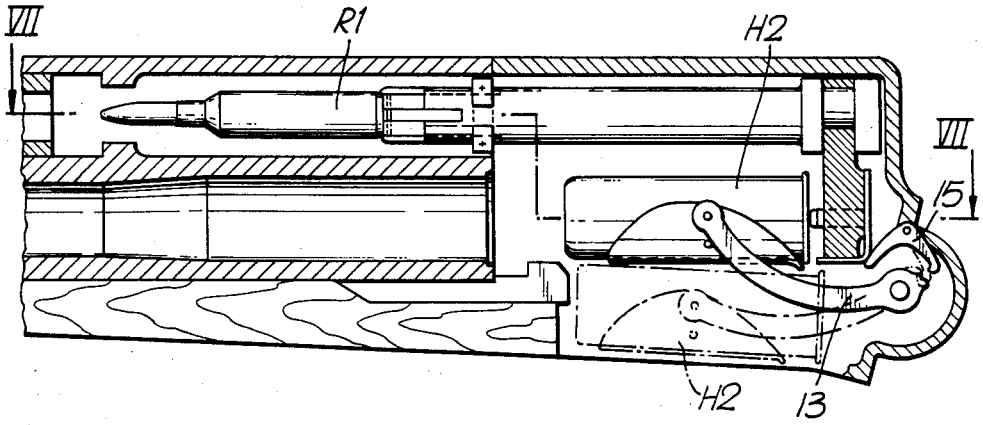
Figure 7:
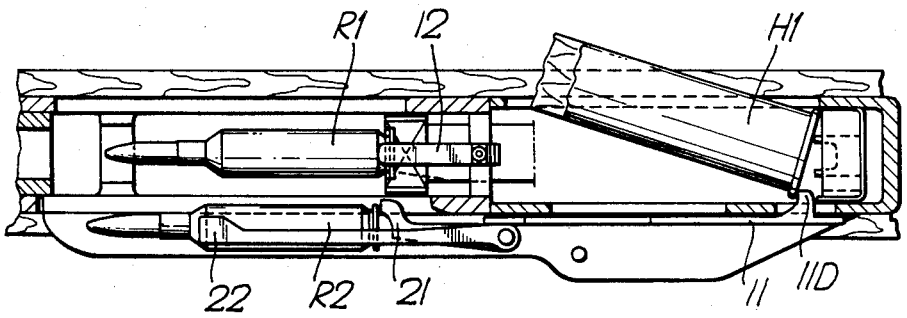

The gun of the invention is illustrated in the accompanying drawings, wherein:

FIG. 1 shows a combination gun with a shotgun barrel and a rifle barrel, in partial cutaway and side view, where the rear position of the breech blocks is partially indicated by the broken lines, FIG. 2 shows the weapon of FIG. 1 in partial cutaway and plan view, also showing the shells in the magazines, FIG. 3 shows the interconnected breech blocks seen from the rear and partially cutaway, FIG. 4 shows the weapon's lock housing and barrel-selector mechanism in partial cutaway and side view, where the breech blocks have been pulled back, FIG. 5 shows the weapon parts of FIG. 4 in partial cutaway and plan view from above, showing the ejection of the rifle shell, FIG. 6 shows the weapon's lock housing with the breech blocks in the rear position, in partial cutaway and side view, and FIG. 7 shows the weapon parts of FIG. 6 in partial cutaway and plan view from above, showing the ejection of the shotgun shell and the position of the barrel-selector mechanism.

FIG. 1 shows an automatic combination weapon having a rifle barrel 25 disposed above a shotgun barrel 26. The breech block 1 of the rifle is connected to the breech block 2 for the shotgun via a cam 1A, so that they together form an interconnected breech block. The joined dual breech block is shown in its forward position, ready for firing. The two breech blocks move as a single member in the parallel direction of the barrels. By pivoting the rifle breech block 1, for example with the aid of a manually operated lever, the cam 1A will cause the shotgun breech block 2 to move either toward or away from the rifle breech block 1 transversely of the barrels. This pivoting movement effects synchronous opening and locking of the two barrels when the breech blocks are in the forward position. The rifle breech block 1 is secured to the receiver 27 with a cylinder lock by means of lugs 24A, while at the same time the shotgun breech block 2 is secured to the receiver 27 by a slide lock by means of lugs 24B.

The above arrangement means that the rifle breech block 1 can only move to and fro in the longitudinal direction of the barrels, and execute a pivoting movement. The shotgun breech block 2, on the other hand, can move to and fro in the longitudinal direction of the barrels as well as toward and away from the barrels in the transverse direction. The interconnected breech block is shown with broken lines in its rear position in FIG. 1. The reciprocating movement of the breech blocks is sufficient to allow a spent shell R1,H1 to be ejected and shells R2 and H2 to be brought into firing position from their respective magazines. The rotary movement of the rifle breech block 1 is about 90° for opening the barrel and a corresponding 90° for closing-/locking the barrel.

FIG. 1 also shows the shotgun shell H1 in position in the magazine, the trigger 4, the rifle stock 28 and the combination shotgun shell holder and extractor 3.

The weapon illustrated in the figures has a cock 7,8 for each barrel 25,26. The cocks 7,8 are arranged on the side of the receiver 27 and strike with a horizontal, pivoting movement against respective firing pins (not shown) which in both cases are cylindrical and whose centerlines coincide with the respective centerlines of their respective breech blocks.

The trigger and selector mechanism are shown in FIGS. 1 and 2, wherein the trigger 4 acts on a tripper 5 which in turn releases the detent 6 which is normally retained in position through the urging of a spring acting in the direction indicated by the arrow. When the detent 6 is released, the cock 7 (or 8) is released for impact. The weapon's barrel-selector mechanism is shown in FIG. 4. The selector mechanism comprises a slide plate 11 having a plurality of locking lugs 11A,11B,11C,11D and 11E. The barrel-selector mechanism permits both barrels to be loaded at the same time, but only one barrel, as selected, to be activated. When one barrel has been brought into an activated or operative state, the functions of the other barrel are blocked and the other barrel is in an inoperative state. Barrel selection is made by pushing the slide plate 11 forwards or backwards. This movement is actuated by means of a handle (not shown) on the side of the receiver 27, which has an eccentric cam that moves in the illustrated vertical slot in the selector slide 11. Turning the handle will cause the selector 11 to be pushed forward or backward.

In an intermediate position of the slide 11, both mechanisms will be blocked, or in an inoperative state (safety).

In FIGS. 4 and 5, the rifle mechanism is shown in the operative state, wherein the cock 7 with a locking pin 9 is free to rotate about an axis 19, to impinge against the firing pin (not shown in the figure) for the rifle barrel.

At the same time, the shotgun mechanism is in an inoperative state because the lug 11 C blocks the cock 8 via a locking pin 10 projecting from the cock 8.

Conversely, FIGS. 6 and 7 show the shotgun mechanism in an operative state, wherein the cock 8 with the locking pin 10 is free to rotate to impinge against the firing pin (not shown) for the shotgun barrel.

At the same time, the rifle mechanism is in an inoperative state because the lug 11 B blocks the cock 7 via the locking pin 9 projecting from the cock 7.

The automatic weapon also has an ejector mechanism for both barrels, which operates according to a known per se principle. The ejector mechanism 21 for the rifle shell cartridge R1 is a separate unit influenced by a spring and turning about an axis 20. When the shotgun barrel 26 is in an operative state, the lug 11A on the sliding plate 11 blocks the ejector mechanism 21 for the rifle shell R1, while at the same time the lug 11A also blocks any movement of the rifle shell lift lever 22, such that the total function of the rifle repeater mechanism is blocked or in an inoperative state. For ejecting the shotgun shell cartridge H1, a lug 11D as shown in FIG. 7 is provided on the sliding plate 11. At the same time, the release catch 15 is disengaged from the shotgun shell lift lever 13, the catch being pivoted by the breech block 2 in its rear position, and this brings the spring-loaded shotgun cartridge lift lever 13 with its follower 18 into position for loading.

The cock 8 which has been fired will be recocked by returning the breech blocks. Then, when the breech blocks are advanced, the shotgun shell H2 will be introduced into the chamber.

When the rifle barrel 25 is in an operative state, the lugs 11A and 11B are in a retracted position, so that both the cock 7 and the ejector mechanism 21 are freely operative. At the same time, the lug 11D on the sliding plate 11 is in a rear position so that it does not come in contact with the shotgun shell and cause it to be ejected. Also, the lug 11E blocks the detent 14 on the shotgun shell lift lever 13, and this prevents the spring-loaded shotgun shell lift lever 13 from introducing the cartridge H2 in the magazine into the shotgun barrel. The detent 14 and shotgun shell lift lever 13 are rigidly connected by a cotter 17 on the shaft 16.

For ejection of the rifle shell cartridge R1, the ejector mechanism 21 becomes functional as the interconnected breech blocks are guided back. A moment later, the release catch (not shown) for the rifle shell lift lever 22 is released by the breech block, and the spring-loaded rifle shell lift lever 22 pivots into a feed position as shown by the double broken lines in FIG. 5.

The cock 7 that was fired will be recocked by guiding the breech blocks back. When the breech blocks are again advanced, the rifle shell R2 will be introduced into the chamber.

The rifle shells are placed in the magazine by opening the rifle magazine cover 23.

As will be understood from the above description, both shells leave their chambers upon initiation of the repeater action, but only the fired cartridge will be ejected. The other shell returns to its position in the chamber when the interconnected breech blocks are advanced and locked. However, if one does not want the shell from the blocked mechanism to follow the breech block's reciprocating movements with the repeater action, one can let the selector slide control a lug which will prevent the shell from leaving the chamber and which at the same time will prevent the ejector catch from engaging with the head of the cartridge. This might be desirable for shotgun mechanisms with automatic repeater action.

The repeater movement, for the above-described weapon, constitutes a 90° rotation of the breech blocks 1 for opening the lock, pulling back the breech blocks and then advancing them, and finally turning the breech blocks 90° back into the locked starting position. This is most simply achieved by fastening a lever to the rear end of the breech block 1, letting the lever project outwardly through a slot in the lock housing which permits 90° rotation and straight-line advancement and retraction of the breech blocks.

Another simple and more rapid repeater action may be obtained by letting a short lever project outwardly a few millimeters from said slot, this lever penetrating into a diagonal slot in a plate which can be moved straight forward and back on or in the lock housing. When the plate is moved straight back, the lever will first be pivoted 90° by the diagonal slot, and then be pushed back into its groove. When the plate is moved forward again, the lever has to follow its straight slot or groove back to its forward position and it is then pivoted 90° in its cross groove by the plate's diagonal slot, assuming a locked starting position.

Said plate with the diagonal slot is secured to one or two recoil thrust bars which by manual, pump-action repetition, are connected to the rifle stock. The stock can slide freely along the outside of one of the barrels, and the repeater action occurs by pumping the stock straight back and forward again.

If the recoil thrust bars are connected to a gas piston instead of the rifle stock, the gas produced by firing the gunpowder can be released from the barrels for urging the piston back, and a spring can be provided for urging it forward again. This principle is known as gas-driven automatic repetitive firing. If the recoil thrust bars are connected to a slide of suitable weight, recoil-driven repeater action is obtained, preferably in combination with utilization of the remaining gas pressure in the chamber.

For mechanisms other than those described above, other forms of automatic repeater action can be imagined, such as pipe recoil and breech block recoil, which are known principles.

The words "repeater mechanism" as used in the appurtenant patent claims are intended to cover the concepts of both manual and automatic repeater action.

It should be understood that the above-described embodiment is exemplary in nature. Thus, although a rifle/shotgun combination is discussed above, the principle described in the foregoing description pertains also to a rifle/rifle or shotgun/shotgun combination, with barrels of different caliber.

Having described my invention, I claim:

1. A gun having a first barrel and a second barrel of different caliber, each barrel having a chamber end, a receiver having sections for guiding and latching first and second interconnected breech blocks, a repeater mechanism, a barrel selector mechanism which brings one barrel into an inoperative state while simultaneously putting the other barrel into an operative state, characterized in that the chamber end of said first barrel is located forward relative to the chamber end of the second barrel by a distance at least corresponding to the overall length of the longest cartridge to be used by one of the barrels, and that the length of the breech block of the second barrel and the corresponding receiver section is reduced at least by the same distance, thereby achieving weight savings and overall length reduction.

2. A gun according to claim 1, characterized in that the two interconnected breech blocks during operation move simultaneously and in parallel in the longitudinal direction of the barrels, and that said breech blocks are connected by a cam mechanism permitting on rotation of the first breech block radial movement of the second breech block, said breech blocks being able to engage lugs provided on the receiver thereby providing a locking action of said breech blocks.

3. A gun according to claim 2, characterized in that the first breech block supports and guides the second breech block.

4. A gun according to claim 1, characterized in that the barrel selector mechanism includes a slideable plate provided with locking lugs permitting both barrels to be loaded simultaneously, but only one barrel, as selected by setting said barrel selector mechanism, to be activated, which includes firing, ejection of a spent shell and the introduction of a new shell, while the corresponding functions for the other barrel are brought into an inoperative state.

* * * * *